US005125853A

United States Patent [19]

Hashiguchi

[11] Patent Number: 5,125,853

[45] Date of Patent: Jun. 30, 1992

[54] ELECTRIC CONNECTOR

[75] Inventor: Osamu Hashiguchi, Tokyo, Japan

[73] Assignee: Japan Aviation Electronics Industry, Limited, Tokyo, Japan

[21] Appl. No.: 703,497

[22] Filed: May 21, 1991

[51] Int. Cl.[5] ..... H01R 13/00

[52] U.S. Cl. ..... 439/607

[58] Field of Search ..... 439/108, 359, 361, 362, 439/607-610

[56] References Cited

U.S. PATENT DOCUMENTS 4,643,509 2/1987 Hollyday et al. ..... 439/607

4,943,244 7/1990 Wah et al. ..... 439/607

*Primary Examiner*—Joseph H. McGlynn

*Attorney, Agent, or Firm*—Laff, Whitesel, Conte & Saret

[57] ABSTRACT

In an electric connector having a fitting portion on a base of an electric insulator, locking appliances for locking connection with another electric connector to the former electric connector and mounting appliances for mounting the electric connector itself on a printed circuit board are provided at insertion holes in blocks formed at opposite ends of the base. Ground straps for grounding the electric connector are provided on the blocks so as to serve to prevent the locking appliances from coming off out of the insertion holes. If the electric connector is a receptacle unit, the fitting portion has a fitting space and first notches provided at opposite ends of the space and different from each other. If the electric connector is a plug unit which is electrically coupled to such a receptacle unit, the fitting portion has a plate-like part which is fitted in the fitting space of the receptacle unit and has second notches provided at opposite ends of the plate-like part and different from each other. The first and the second notches are asymmetrically formed so that the plate-like part can be fitted in the fitting space only when the plate-like part and the fitting space are properly oriented to each other.

6 Claims, 10 Drawing Sheets

ELECTRIC CONNECTOR

BACKGROUND OF THE INVENTION

The present invention relates to an electric connector, and more particularly, to an electric connector including locking means for locking the connector and a mating electric connector in an electrical connection therebetween, mounting means for mounting the electric connector onto a mother board such as a printed circuit board, ground straps for grounding the electric connector, and a construction for preventing the electric connector from being improperly fitted to the mating connector.

A conventional electric connector includes an electric insulator, and blocks formed at opposite ends of the insulator. The blocks have insertion holes receiving hexagonal nuts therein. Each of the insertion holes has a hexagonal inner surface in contact with the outer surface of the hexagonal nut and is provided with a pair of ribs on the inner surface which closely fit to diametrically opposite portions of the outer surface of the hexagonal nut.

Another conventional electric connector includes an electric insulator, and blocks formed at opposite ends of the insulator. The blocks have insertion holes in which hexagonal nuts are held. Each of the insertion holes has opposite inner surfaces which face the two axially opposite sides of the hexagonal nut. A plurality of ribs are formed on the opposite inner surfaces and closely fit the nut received in the insertion hole.

In another construction, the inner surface of each insertion hole is provided with a plurality of ribs to closely fit the hexagonal outer surface of the nut.

As for each of the conventional electric connectors, the hexagonal nuts are press-fitted into the insertion holes. As a result, the peripheral surfaces of the nuts or the opposite sides thereof are pinched by the ribs so that the nuts are held in the insertion holes. Bolts are inserted through the tapped holes of the nuts to mount the electric connector on a mother board such as a printed circuit board. Further, bolts are used to conjoin the nuts to other nuts provided in the blocks of a mating electric connector.

However, since it is likely due to the press-fitting of the hexagonal nuts into the insertion holes of the blocks that the ribs are worn or deformed or the blocks are chipped, there is a problem that the nuts are likely to come off out of the insertion holes. There is another problem that if the hexagonal nuts are not completely held in the insertion holes, the nuts are likely to come off out of the holes due to a vibration or the like during the conveyance of the electric connector.

The conventional electric connectors can be plug units or receptacle units, which can be mated or fitted to each other to be electrically coupled to each other. The connector as the plug unit and the connector as the receptacle unit have fitting portions for mating the connectors to each other. The fitting portions are provided with metal covers or metal shells which are for electromagnetically shielding and properly guiding the fitting portions to fit them to each other. Some such metal shells are integrally formed with ground straps for electrically grounding the electric connectors, as described in the U.S. Pat. No. 32,502 granted to Vijay Kumar, Harrisburg, Pa.

Since the fitting portions are symmetrically shaped, there is a problem that the fitting portion of the connector as the plug unit and the fitting portion of the connector as the receptacle unit are likely to be improperly fitted to each other, because they can be fitted to each other as one of the connectors is turned the other way. If the size of each of the connectors is reduced, the thickness of the metal shell is reduced. As a result, asymmetry of the metal shell cannot be made sufficient because the magnitude of the angle thereof and the magnitude of the radius of curvature thereof are limited in the forming process of the metal shell. If such connectors are fitted to each other by a strong force, there is a problem that the metal shells are likely to be deformed to allow the fitting portions to be improperly fitted to each other.

Although the ground straps serve to ground the metal shells, the straps do not function to prevent the hexagonal nuts from coming off out of the insertion holes.

SUMMARY OF THE INVENTION

Accordingly, it is an object of the present invention to provide an electric connector wherein the locking means and mounting means are prevented from coming off out of insertion holes for holding them.

It is another object of the present invention to provide an electric connector which does not undergo improper fitting even if it is reduced in size.

It is yet another object of the present invention to provide an electric connector having ground straps which can hold the locking means and ground the metal shell.

An electric connector according to this invention comprises an electric insulator including a base having a main surface, a fitting portion provided on the main surface, and blocks provided at opposite ends of the base, each of the blocks having a support surface parallel with the main surface and a mounting surface perpendicular to the main surface; electroconductive contact members provided at the fitting portion; a metal shell attached to the base around the fitting portion; flanges provided at opposite ends of the shell each supported onto the support surface; locking means attached to each of the blocks; mounting means attached to each of the blocks; and a ground strap of a metal attached to each of the block in electronconductive contact with each of the flanges and extending along the support surface and the mounting surface.

The locking means comprises a first hexagonal nut attached to the block. The block is provided with a first insertion hole which extends from a surface opposite the mounting surface and is oriented in a direction parallel with the support surface and intersecting the mounting surface. The first hexagonal nut is held in the first insertion hole. The ground strap attached to the block is partially located at an open end of the first insertion hole so as to prevent the first hexagonal nut from coming off out of the first insertion hole.

The mounting means comprises a second hexagonal nut attached to the block. The block has a second insertion hole extending along the mounting surface from a surface opposite the support surface. The second hexagonal nut is held in the second insertion hole. The size of an open end of the second insertion hole is smaller than a distance between diametrically opposite flat surface portions of the outer surface of the second nut. The block is formed with a slit communicating with and extending along the second insertion hole, and projections for preventing the second hexagonal nut from coming off out of the second insertion hole.

In case an electric connector is a receptacle unit, the fitting portion comprises a stump part formed on the main surface, a fitting space formed in the stump part and accommodating the electroconductive contact members therein, and notches provided at opposite ends of the space and different from each other.

In case an electric connector is a plug unit, the fitting portion comprises a stump part projecting from the main surface, a plate-like part extending up from the stump part and fitted with the electroconductive contact members on at least one side of the plate-like part, and notches provided in the plate-like part at opposite ends thereof and different from each other.

DESCRIPTION OF THE PREFERRED EMBODIMENTS

Before preferred embodiments of the present invention are described, conventional electric connectors are described with reference to FIGS. 1, 2, 3, 4 and 5 in order to facilitate the understanding of the present invention.

Figure 1:
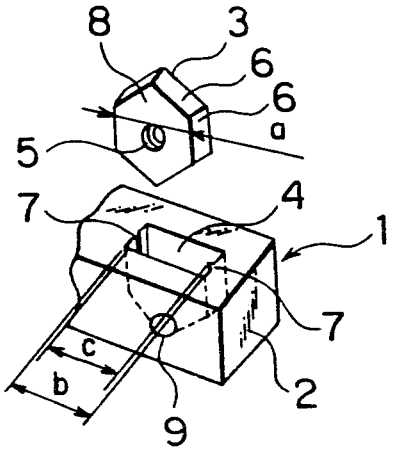
FIG. 1 is a perspective view of the block of a conventional electric connector.

One of the conventional electric connectors includes an electric insulator 1, and blocks 2 formed at opposite ends of the insulator, as shown in FIG. 1. Each of the blocks 2 has an insertion hole 4 in which a hexagonal nut 3 is held. The nut 3 has an outer surface which comprises six flat surface portions 6. The insertion hole 4 has an inner surface which comes into contact with the outer surface of the nut 3, and two ribs 7 on the inner surface at locations which face the diametrically opposite surface portions 6 of the nut 3. A distance a between the diametrically opposite surface portions 6 of the nut 3, another distance b between the locations of the inner surface having the ribs 7, and another distance c between the ribs 7 are determined as $c<a<b$. The block 2 has bolt holes 9 in opposite wall portions of the insertion hole 4 which face the opposite sides 8 of the hexagonal nut 3. The bolt holes 9 are opposed to the tapped hole 5 of the nut 3 in the axial direction thereof when the nut is held in the insertion hole 4.

Figure 2:
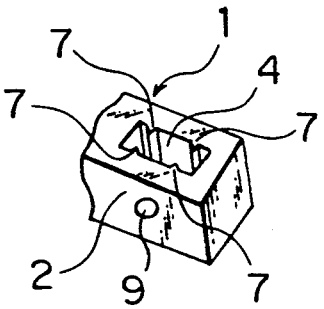
FIG. 2 is a perspective view of the block of another conventional electric connector.

Referring to FIG. 2, in another conventional electric connector, a plurality of ribs 7 are formed on opposite surfaces in the insertion hole 4 which face the opposite sides 8 of the hexagonal nut 3 held in the insertion hole 4. Bolt holes 9 are also formed in the opposite surfaces and are opposed to the tapped hole 5 of the hexagonal nut 3 when the nut is held in the insertion hole 4.

Figure 3:
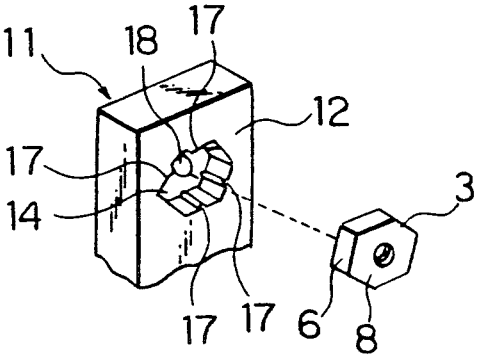
FIG. 3 is a perspective view of the block of yet another conventional electric connector.

Referring to FIG. 3, yet another conventional electric connector includes an electric insulator 11, and blocks 12 formed at opposite ends of the insulator. Each of the blocks 12 has a bottomed insertion hole 14 in which a hexagonal nut 3 similar to that shown in FIG. 1 is held. The block 12 has a bolt hole 18 in the bottom of the insertion hole 14. A bolt is inserted through the bolt hole 18. The inner surface of the insertion hole 12 has a plurality of ribs 17 to closely fit the six flat surfaces 6 of the hexagonal nut 3 received in the hole 14.

The conventional electric connectors can be mounted onto a printed circuit board or locked to a mating connector by engaging a bolt with the nut 3. Since it is likely due to the press-fitting of the hexagonal nuts 3 into the insertion holes 4 and 14 of the blocks 2 and 12 that the ribs 7 and 17 are worn or deformed or the blocks are chipped, there is a problem that the nuts are likely to come off out of the insertion holes.

Figure 4:
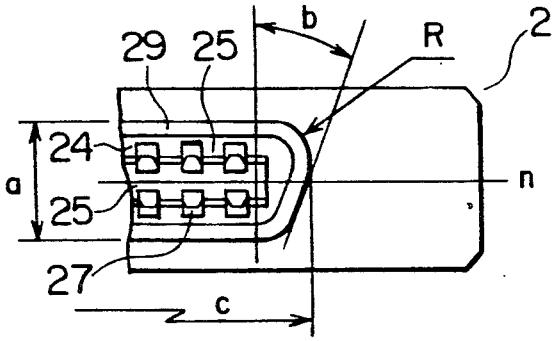
FIG. 4 is a partial front view of the fitting portion and metal shell of such a conventional electric connector which is a plug unit.
Figure 5:
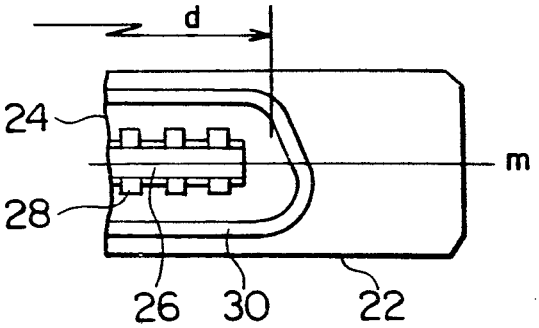
FIG. 5 is a partial front view of the fitting portion and metal shell of such a conventional electric connector which is a receptacle unit.

A receptacle unit 21 shown in FIG. 4 and a plug unit 22 shown in FIG. 5 are also conventional electric connectors. The plug unit 22 is mated with the receptacle unit 21 so that they are electrically coupled to each other. The connectors 21 and 22 have fitting portions 25 and 26 for fitting the electric insulators 23 and 24 of the connectors to each other. The fitting portion 25 of the receptacle unit 21 is made of a space in which the fitting portion 26 of the plug unit 22 is fitted. The fitting portion 26 of the plug unit 22 is a plate-like portion which is fitted in the fitting portion 25 of the receptacle unit 21.

Electroconductive contact members 27 are provided in the fitting portion 25. Electroconductive contact members 28 are provided on the fitting portion 26. The fitting portions 25 and 26 are provided with metal shells 29 and 30. The metal shells 29 and 30 are provided with ground straps which are not shown in FIGS. 4 and 5 and are for grounding the metal shells 29 and 30. Since the fitting portions 25 and 26 are shaped symmetrically with regard to the longitudinal center lines m and n of the connectors 21 and 22, the fitting portions are likely to be improperly fitted to each other if the metal shells 29 and 30 are not provided. If the connectors 21 and 22 are to be reduced in size, a width dimension a of the shell 29 of the connector 21 is decreased. In that case, a magnitude of an angle b between adjacent two walls and a curvature R of a corner of the shell 29 are limited due to the forming condition of the shell 29. As a result, the difference is reduced between a longitudinal dimension c of the shell 29 and that d of the other cover 30. This causes a problem that if the connectors 21 and 22 are mated to each other by a strong force, the shells are likely to be deformed to improperly fit the connectors to each other.

An electric connector 41 which is one of the preferred embodiments id described with reference to FIGS. 6, 7, 8, 9, 10, 11, 12, 13, 14, 15 and 16 from now on.

Figure 9:
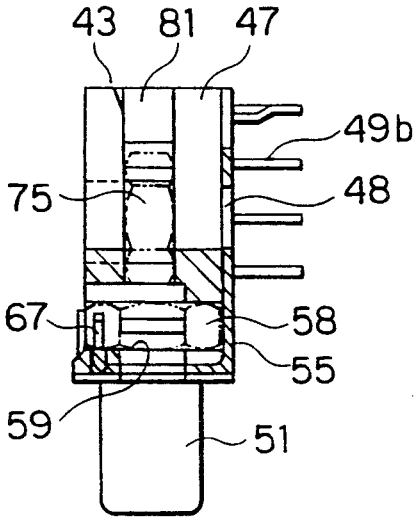
FIG. 9 is a sectional view of the connector along a line IX—IX shown in FIG. 8.

The electric connector 41 is a receptacle unit. The connector 41 includes an electric insulator 43. The insulator 43 has a base 45 having a main surface 44, a fitting portion 46 provided on the main surface, and a pair of blocks 47 provided at opposite ends of the base, each having a support surface 47*a* extending in parallel with the main surface and a mounting surface 48 extending rectangularly to the main surface. The connector 41 also includes a plurality of electroconductive contact members 49 provided in the fitting portion 46, and a shell 51 which is made of a metal and attached to the base 45 and covers the fitting portion. A plurality of projections 53, 53*a*, and 53*b* are provided on opposite sides of the base 45 but adjacent the main surface 44. The shell 51 has engagement portions 54, 54*a*, and 54*b* corresponding to the projections 53, 53*a*, and 53*b* and engaged therewith, respectively. The shell 51 has flanges 52 at opposite ends thereof so that the flanges are supported on the support surfaces 47*a* of the blocks 47. Locking means and mounting means, which are described hereinafter, are attached to the blocks 47. Ground straps 55 made of a metal are attached to the blocks 47. The ground straps 55 are located in electroconductive contact with the flanges 52, and extend along the support surfaces 47*a* and mounting surfaces 48 of the blocks 47, as shown in FIGS. 7 and 9. Each block 47 is formed with bolt holes 61 extending from the support surfaces 47*a* to a first insertion hole 59 formed in the block 47. The bolt hole 61 is coincident with a bolt hole 63 in each flange 52 in the direction. , The locking means comprises first hexagonal nuts 58 attached to the blocks 47, as shown in FIGS. 6, 7, 8, 9, and 12. Each of the blocks 47 is formed with the first insertion hole 59 which extends from a surface opposite the mounting surface 48 in a direction parallel with the support surface 47*a* and intersecting the mounting surface. The first insertion hole 59 has an open end in the surface opposite the mounting surface 48. The inner surface of the first insertion hole 59 has a V-shaped portion 64 at a bottom of the first insertion hole 59 which is corresponding to an adjacent pair of the six flat outer surface portions 65 of a first hexagonal nut 58. The inner surface has a pair of opposite surface portions 65 which come into contact with a diametrically opposite ones of the six flat outer surface portions of the first hexagonal nut 58 held in the hole.

Figure 13:
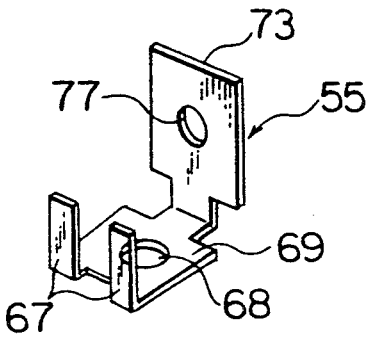
FIG. 13 is a perspective view of a ground strap shown in FIG. 7.

Each of the ground straps 55 has two fingers 67, as shown in FIGS. 7, 9, and 13. The fingers 67 are located at the open end of the first insertion hole 59 to prevent the first hexagonal nut 58 from coming out of the first insertion hole 59. The ground strap 55 has a contact portion 69 having a first bolt hole 68 through which a bolt (not shown) should be engaged. The axial direction of the first bolt hole 68 is coincident with that of the tapped hole 71 of the first hexagonal nut 58. The ground strap 55 has a mounting portion 73 bent at one end of the contact portion 69 rectangularly thereto to extend along the mounting surface 48 of the block 47. The mounting portion 73 has a second bolt hole 77 in a direction coincident with that of the tapped hole 76 of a second hexagonal nut 75. The fingers 67 and the mounting portion 73 are coupled to each other by the contact portion 69 and extend in parallel with each other. The ground strap 55 is manufactured by bending a plate to shape it as J. The fingers 67 keep the first hexagonal nut 58 in the first insertion hole 59 by engagement with another adjacent flat outer surface portions of the nut 58.

When the first hexagonal nut 58 is inserted into the first insertion hole 59 and the ground strap 55 is mounted onto the block 47, the four flat outer surface portions of the nut 58 are pinched by the fingers 67 of the ground strap 55 and the V-shaped bottom surface portion 64 of the first insertion hole 59 so that the nut 58 is held in the hole 59 and does not fall out of the hole. When the ground strap 55 is firmly attached to the block 47, the shell 51 is grounded through the flange 52 located in contact with the strap.

The bolt is engaged with the first hexagonal nut 58 and is coupled to a second hexagonal nut 75 provided in the block 47 of an electric connector as a plug unit described hereinafter.

Figure 14:
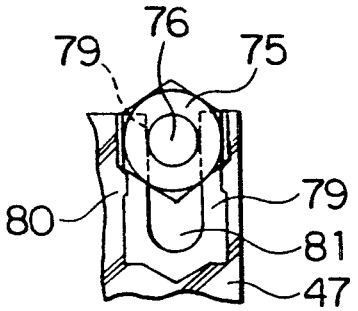
FIG. 14 is a sectional view of a mounting means and an insertion hole in the state that the mounting means is not yet completely inserted into the hole.
Figure 15:
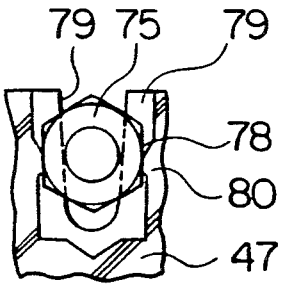
FIG. 15 is a sectional view of the mounting means and the insertion hole in the state that the mounting means is being inserted into the hole.
Figure 16:
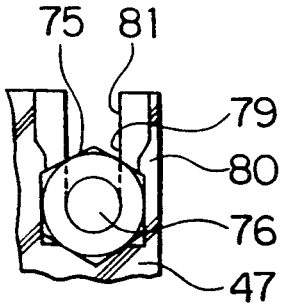
FIG. 16 is a sectional view of the mounting means and the insertion hole in the state that the mounting means is completely inserted into the hole.
Figure 17:
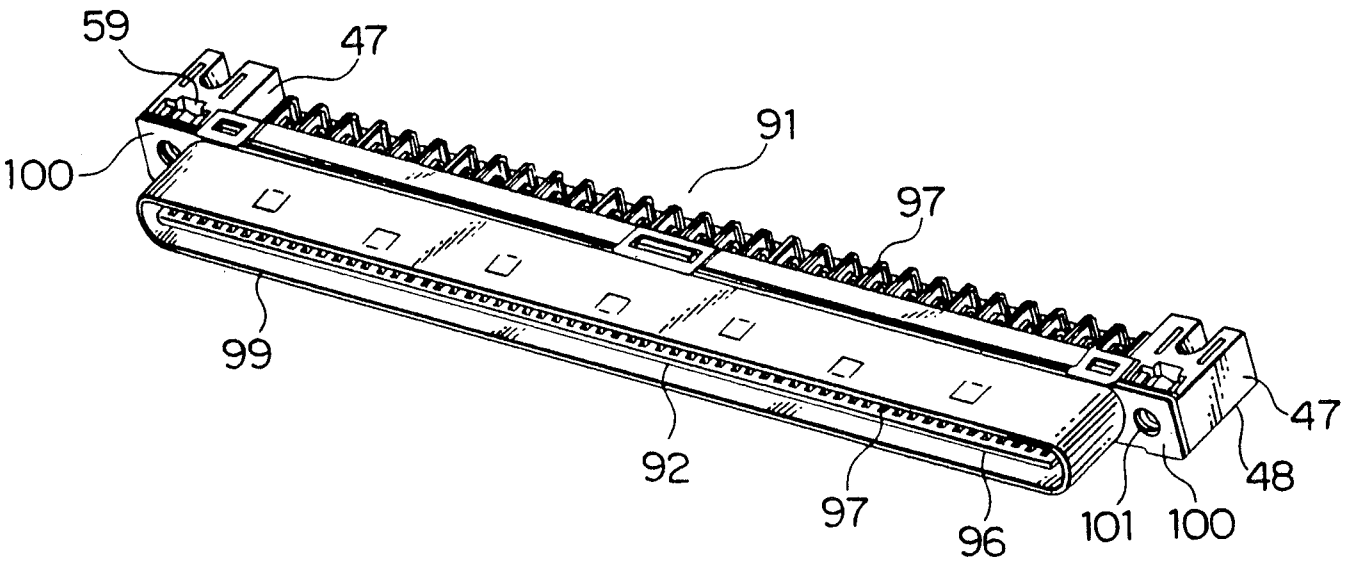
FIG. 17 is a perspective view of an electric connector which is another embodiment of the present invention as a plug unit.
Figure 18:
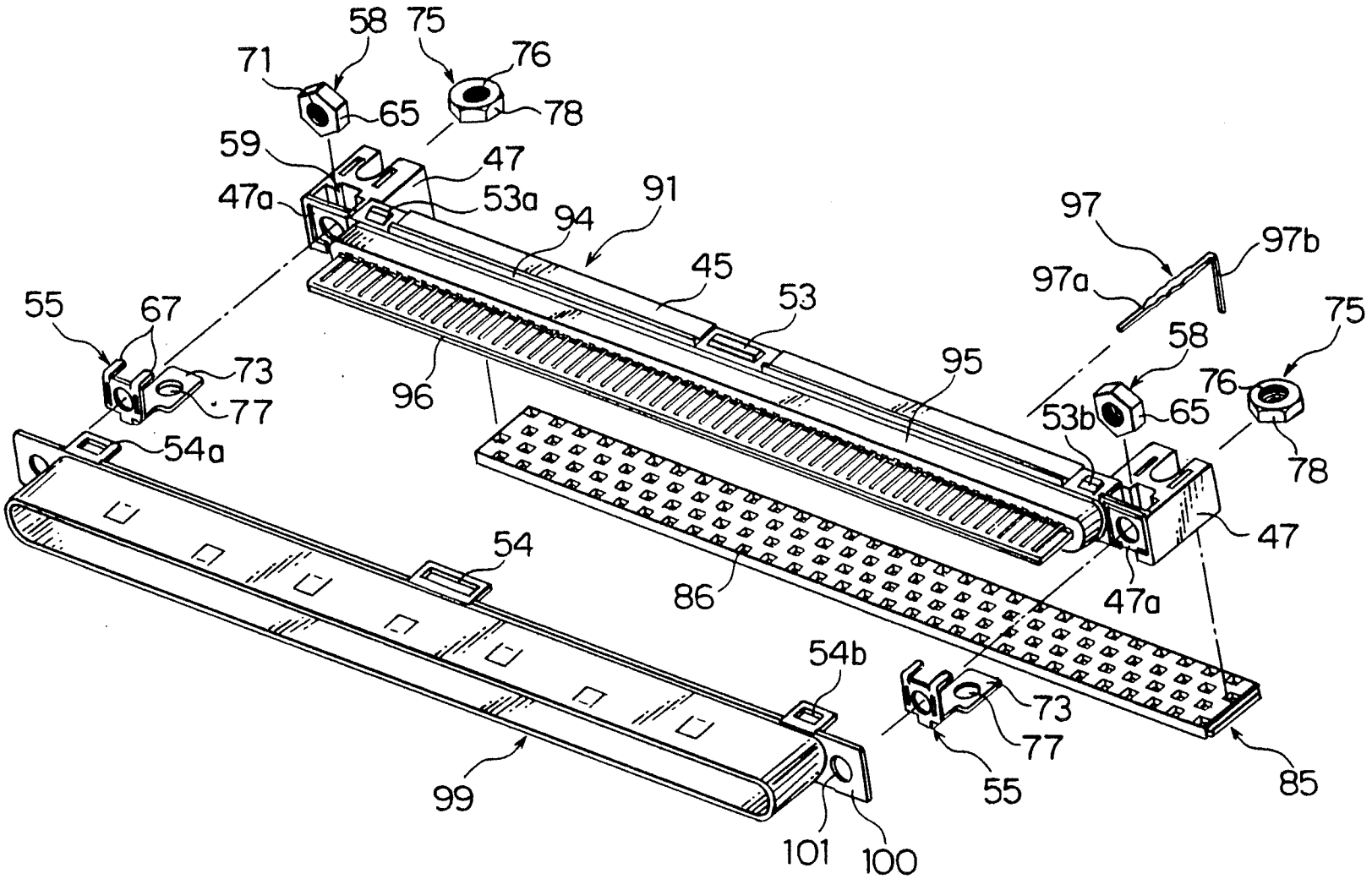
FIG. 18 is an exploded perspective view of the connector shown in FIG. 17.
Figure 19:
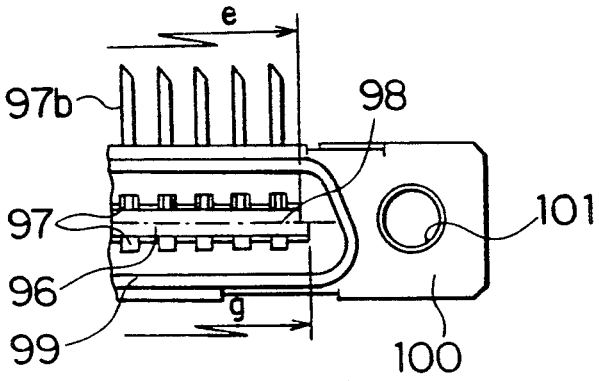
FIG. 19 is a partial front view of the fitting portion of the connector shown in FIG. 17.
Figure 20:
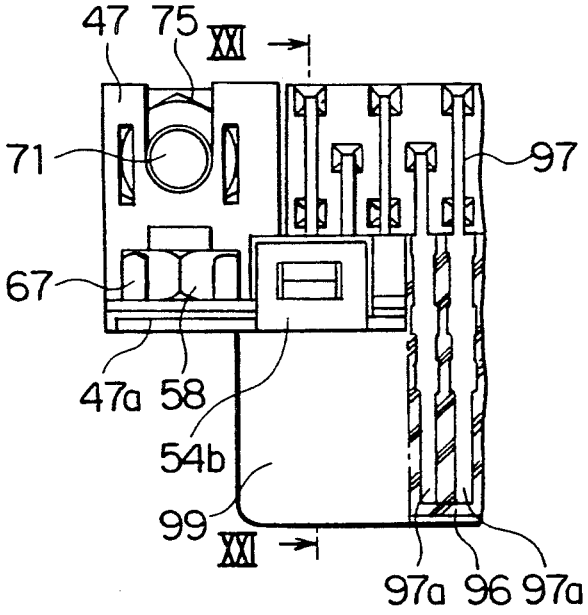
FIG. 20 is a plan view of a main part of the connector shown in FIG. 17.
Figure 21:
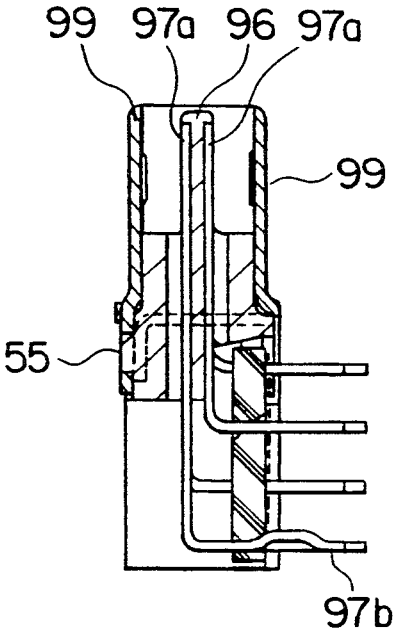
FIG. 21 is a sectional view of the connector along a line XXI—XXI shown in FIG. 20.
Figure 22:
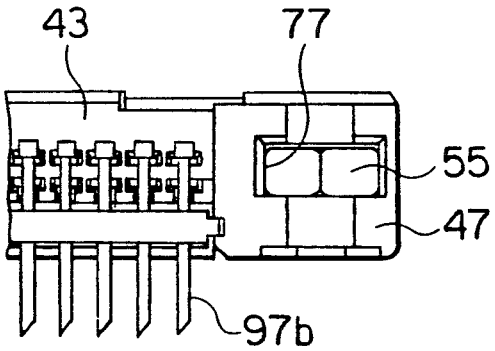
FIG. 22 is a bottom view of the connector shown in FIG. 20.

The mounting means comprises a second hexagonal nut 75 attached to the block 47 of the electric insulator 43 of the electric connector 41. The block 47 has a second insertion hole 81 extending along the mounting surface 48 of the block from a surface opposite the support surface 47*a* of the block, as shown in FIGS. 14, 15, and 16. The second hexagonal nut 75 is held in the second insertion hole 81. The size of the open end of the second insertion hole 81 is smaller than a distance between diametrically opposite flat surface portions of the outer surface 78 of the second hexagonal nut 75. The block 47 has a slit 79 communicating with the second insertion hole 81 and extending along it. Projections 80 are formed on a portion of the inner surface of the second insertion hole 81. Each projection 80 comprises an oblique portion extending down obliquely inward from the open end of the second insertion hole toward the bottom thereof and a step portion located under the oblique portion, and engages with the outer surface of the nut when the nut is completely inserted into the hole 81 so as to be held in the hole 81. When the second hexagonal nut 75 is inserted into the second insertion hole 81, the nut is press-fitted into the lower portion of the hole under the projections 80. As a result, the step portions of the projections 80 engage the outer surface of the nut 25 to prevent the nut from coming out of the hole 81.

A distance a between the diametrically opposite flat outer surface portions 78 of the second hexagonal nut 75, another distance b between opposite inner surfaces of the lower portion of the second insertion hole 81 corresponding to the diametrically opposite flat outer surface portions 78, a distance c between the projections 80, and the size d of the open end of the hole 81 are conditioned as $c<a\leqq b<d$. The distances a and b are nearly equal to each other. The size d is such that the second hexagonal nut 75 can be tentatively inserted into the second insertion hole 81. A bolt is engaged with the second hexagonal nut 75 to mount the electric connector 41 to a printed circuit board.

Figure 6:
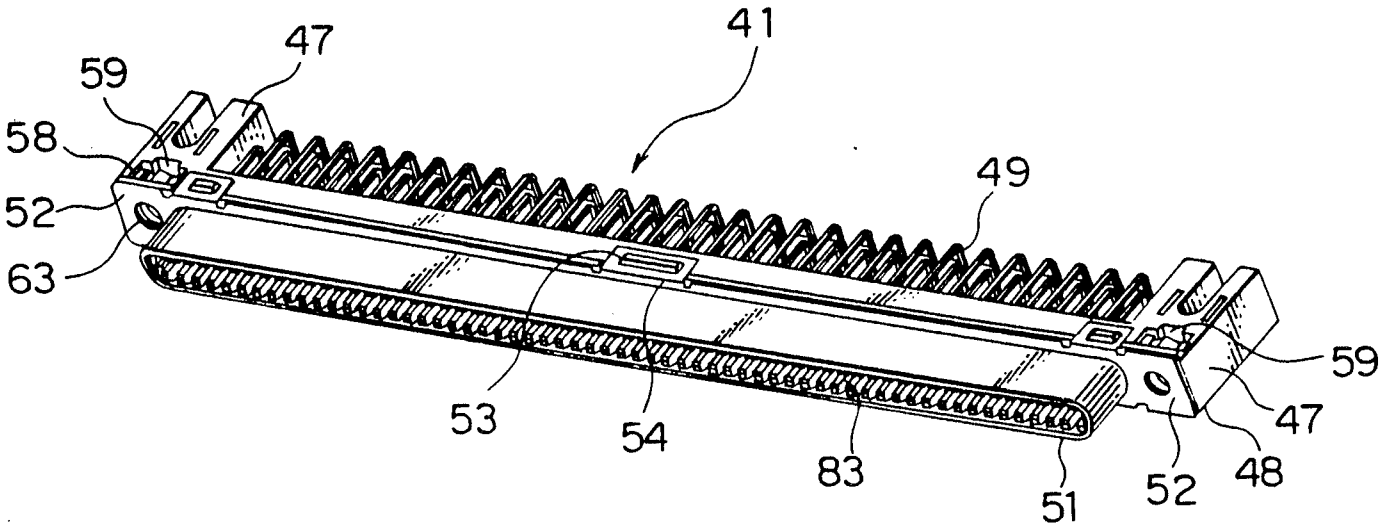
FIG. 6 is a perspective view of an electric connector which is an embodiment of the present invention as a receptacle unit.
Figure 7:
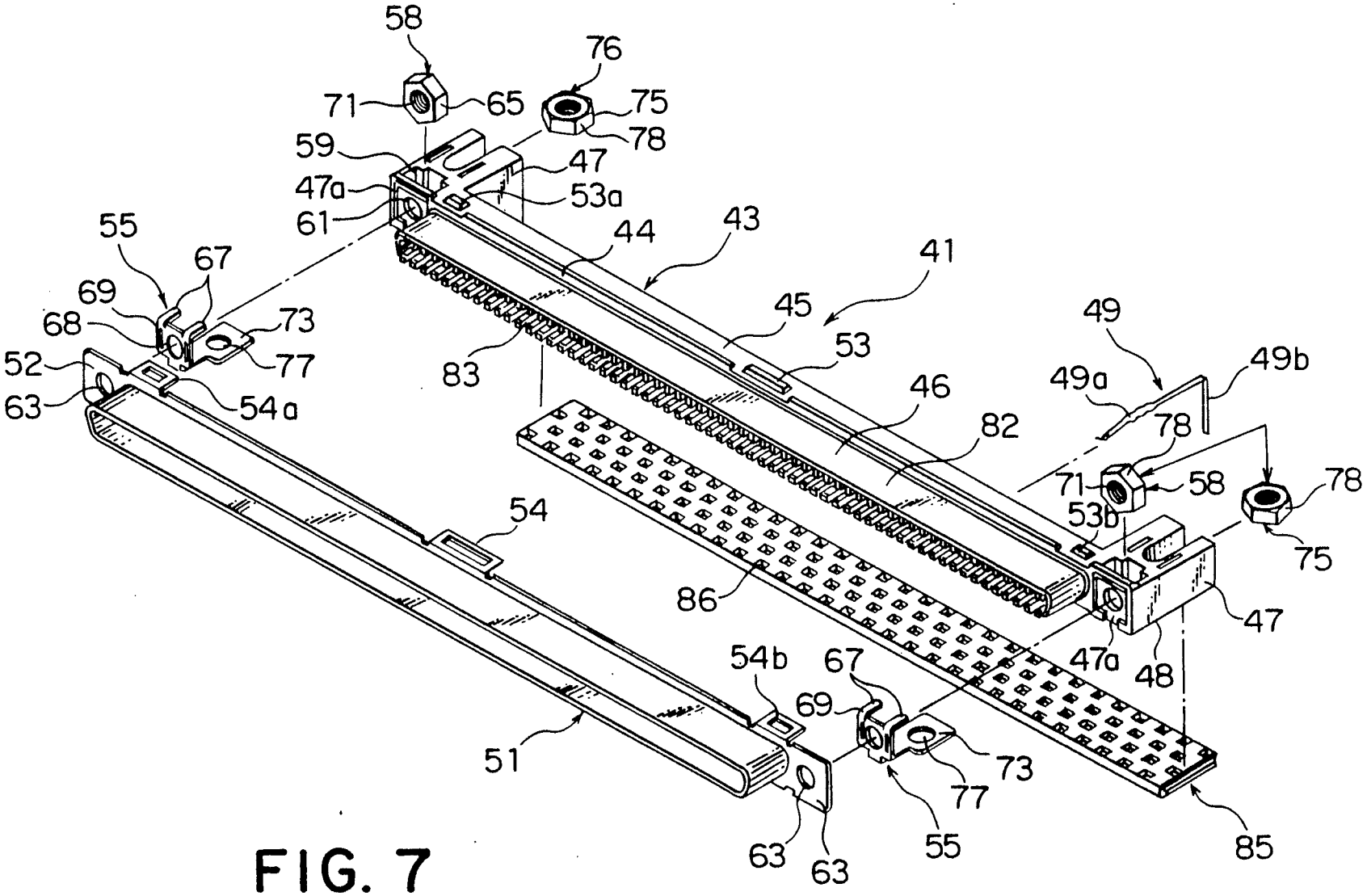
FIG. 7 is an exploded perspective view of the connector shown in FIG. 6.
Figure 8:
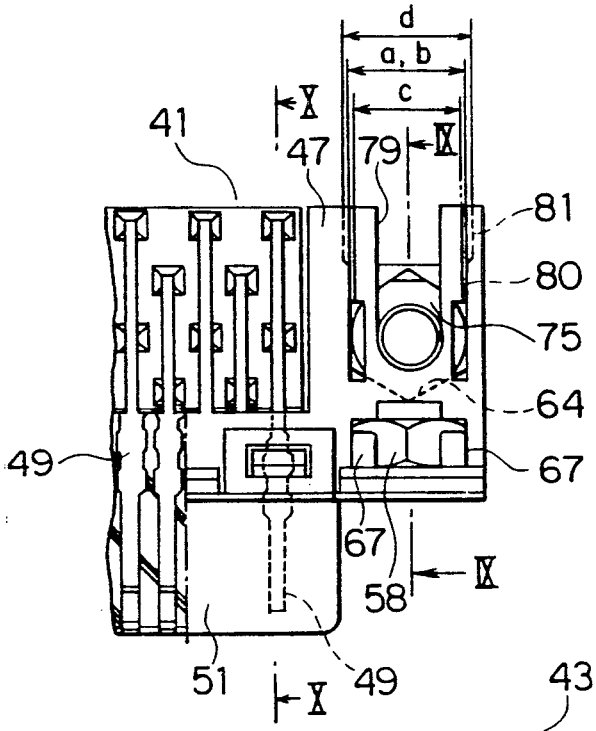
FIG. 8 is a partially sectional plan view of a main part of the connector shown in FIG. 6.
Figure 10:
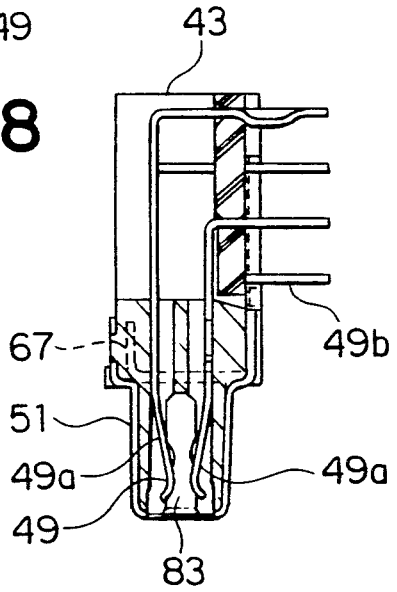
FIG. 10 is a sectional view of the connector along a line X—X shown in FIG. 8.
Figure 11:
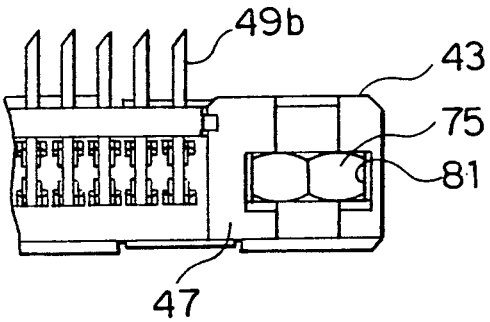
FIG. 11 is a bottom view of the connector shown in FIG. 6.
Figure 12:
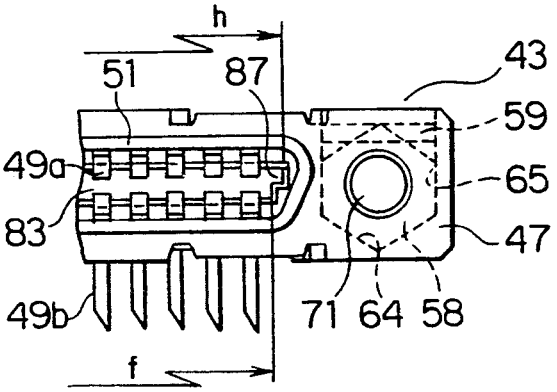
FIG. 12 is a front view of the connector shown in FIG. 6.

The fitting portion 46 comprises a stump portion 82 formed on the main surface 44, and a fitting space 83 formed in the stump portion, as shown in FIGS. 6, 7, and 10. The contact portions 49*a* of the contact members 49 each having a spring-like property are juxtaposed at intervals in the fitting space 83. The contact members 49 are disposed in two rows in the fitting space 83, and have terminal portions 49*b* extending from the ends of the contact portions 49*a* outside the base 45. Each contact member 49 is angularly bent. The terminal portions 49*b* are inserted through the holes 86 of an electrically insulating locator 85 provided on the mounting surfaces 48 of the blocks 47, and are then electrically coupled to the printed circuit board. The fitting space 83 has a size to permit the contact portions 49*a* to deform so that the distance between the contact portions 49*a* can be increased. The fitting portion 46 has fitting notches 87 at opposite ends of the fitting space 83. The fitting notches 87 are shaped differently from each other so that steps are formed at the ends of the fitting space 83. The notches are not symmetric to each other with regard to the center of the space, and the longitudinal dimension f of the space at one of the notches and that h of the space at the other of the notches are conditioned as $f<h$. Each of the notches 87 is not confined to form the steps at the end of the fitting space 83, but may be formed in a D-shape similarity to the end of the shell 51.

When the first hexagonal nut 58 is attached to the block 47 with the ground strap 55 as described above, the nut is secured in the first insertion hole 59. The second hexagonal nut 75 is pinched by the projections 80 so that the nut is secured in the second insertion hole 81. As a result, the first and the second hexagonal nuts 58 and 75 are prevented from coming out of the first and the second insertion holes 59 and 81 during the conveyance of the electric connector.

An electric connector as the above-mentioned plug unit according to another of the preferred embodiments is described with reference to FIGS. 17, 18, 19, 20, 21, and 22 from now on. The electric connector is similar in constitution to the preceding electric connector except for the fitting portion of the electric insulator, the shell and the contact members. Therefore, some parts of the plug unit connector, which are similar in constitution to the corresponding parts of the preceding connector, are denoted by the same reference symbols as the latter parts, and not described in detail herein. The plug unit connector includes an electric insulator 91. The insulator 91 has a fitting portion 92 which has a stump part 95 projecting from a main surface 94 and has a plate-like part 96 projecting from the stump part. The connector also includes electroconductive contact members 97 bent angularly and provided on at least one side of the plate-like part 96. Each of the contact members 97 has a contact portion 97*a* provided on the plate-like part 96, and a terminal portion 97*b* extending from one end of the contract portion. The contact portion 97*a* extends along the direction of the projecting of the plate-like part 96. The plate-like part 96 has notches 98 at both ends of the part. The notches 98 are different from each other. A shell 99 made of a metal is attached to the base 45 of the insulator 91, and covers the fitting portion 92. The shell 99 has flanges 100 at its opposite ends. The flanges 100 are supported by the support surfaces 47*a* of the blocks 47 of the insulator 91, and have bolt holes 101. A plurality of projections 53, 53*a*, and 53*b* are provided on a side of the base 45 but adjacent the main surface 94. The shell 99 has engagement portions 54, 54*a*, and 54*b* engaged with the projections 53, 53*a*, and 53*b* of the base 45, respectively. The notches 98 are shaped differently from each other so that steps are formed at the ends of the plate-like part 96, and the notches are not symmetric to each other with regard to the center of the part. The longitudinal dimension e of the plate-like part 96 at one of the notches and that g of the part 96 at the other of the notches are conditioned as $e<g$. The dimensions e, f, g, and h of the electric connectors are conditioned as $e<f<g<h$. As a result, the electric connectors are prevented from being improperly fitted to each other even in case that they are tried to be fitted to each other as one of them is turned upside down.

The notched 98 are not confined to form the steps at the ends of the plate-like part 96, but may be formed in D-shape similarly to the end of the shell 99. The notches 87 and 98 may thus be shaped in various forms. What is important about the forms of the notches 87 and 98 is that they are asymmetrically shaped to allow the fitting space 83 and the plate-like part 96 to be fitted to each other only when the electric connectors are properly oriented to each other.

Figure 23:
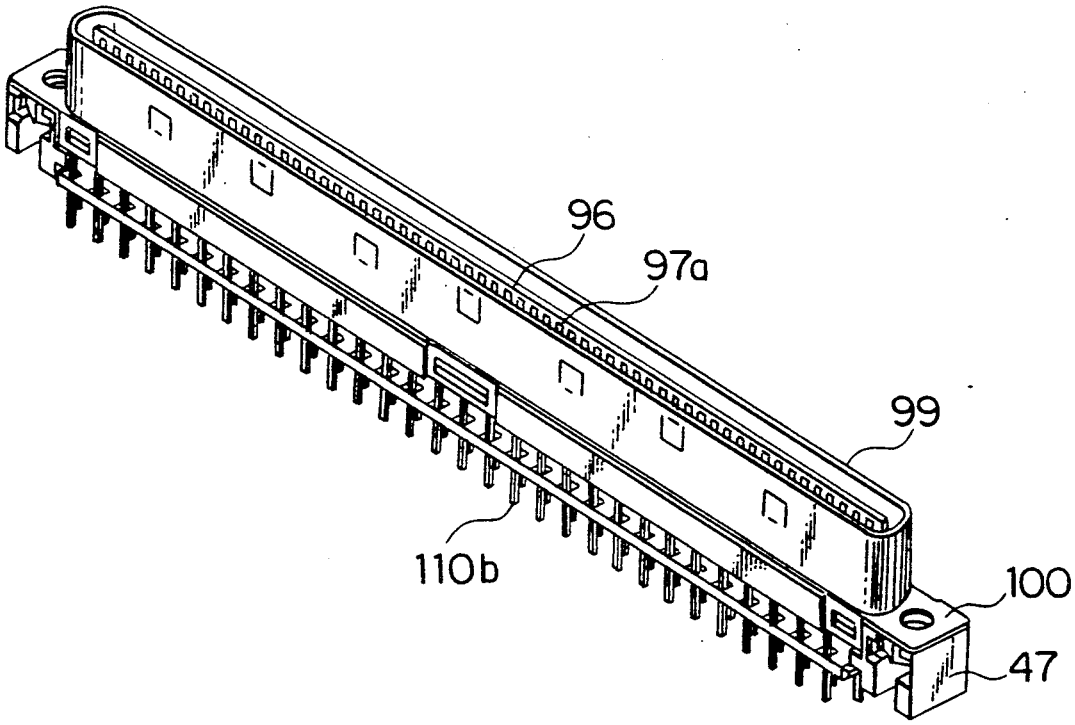
FIG. 23 is a perspective view of an electric connector which is yet another embodiment of the present invention as a plug unit.
Figure 24:
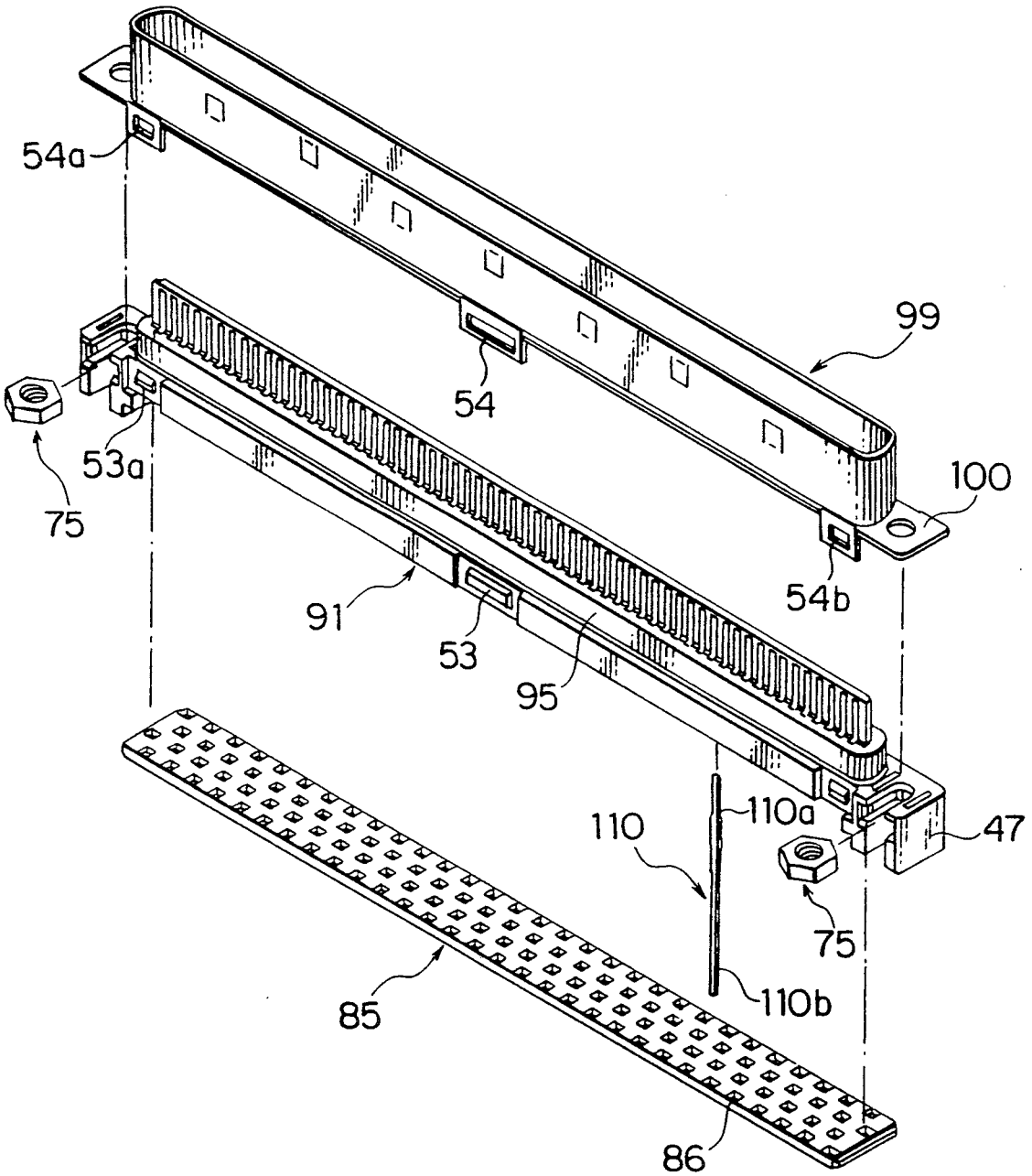
FIG. 24 is an exploded perspective view of the connector shown in FIG. 23.

FIGS. 23 and 24 show an electric connector which is a plug unit and is yet another of the preferred embodiments. The electric connector is constituted similarly to the preceding plug unit connector except the connector shown in FIGS. 23 and 24 has a fitting portion 93 which is mounted in a vertical position to a printed circuit board. The electroconductive contact members 110 of the electric connector shown in FIGS. 23 and 24 are straight members having contact portions 110*a* provided on a plate-like part 96, and terminal portions 110*b* extending straight from the ends of the contact portions. The mounting means of the electric connector are made of first hexagonal nuts 58, which are inserted into first insertion hole 59. The locking means of the connector are made of second hexagonal nuts 75, which are inserted into second insertion holes 81.

What is claimed is:

1. An electric connector comprising an electric insulator including a base having a main surface, a fitting portion provided on said main surface, and blocks provided at opposite ends of said base, each of said blocks having a support surface parallel with said main surface and a mounting surface perpendicular to said main surface; electroconductive contact members provided at said fitting portion; a metal shell attached to said base around said fitting portion; flanges provided at opposite ends of said shell each supported onto said support surface; locking means attached to each of said blocks; mounting means attached to each of said blocks; and a ground strap of a metal attached to each of said block in electroconductive contact with each of said flanges and extending along said support surface and said mounting surface.

2. An electric connector according to claim 1, wherein said locking means comprises a first hexagonal nut attached to said block; said block being provided with a first insertion hole which extends from a surface opposite said mounting surface and is oriented in a direction parallel with said support surface and intersecting said mounting surface; said first hexagonal nut being held in said first insertion hole; and said ground strap attached to said block being partially located at an open end of said first insertion hole so as. to prevent said first hexagonal nut from coming off out of said first insertion hole.

3. An electric connector according to claim 1, wherein said mounting means comprises a second hexagonal nut attached to said block; said block having a second insertion hole extending along said mounting surface from a surface opposite said support surface; said second hexagonal nut being held in said second insertion hole; the size of an open end of said second insertion hole being smaller than a distance between diametrically opposite flat surface portions of the outer surface of said second nut; and said block being formed with a slit communicating with and extending along said second insertion hole, and projections for preventing said second hexagonal nut from coming off out of said second insertion hole.

4. An electric connector according to claim 1 being a receptacle unit, wherein said fitting portion comprises a stump part formed on said main surface, a fitting space formed in said stump part and accommodating said electroconductive contact members therein, and notches provided at opposite ends of said space and different from each other.

5. An electric connector according to claim 1 being a plug unit, wherein said fitting portion comprises a stump part projecting from said main surface, a plate-like part extending up from said stump part and fitted with the electroconductive contact members on at least one side of said plate-like part, and notches provided in said plate-like part at opposite ends thereof and different from each other.

6. An electric connector comprising a combination of a receptacle unit and a plug unit; wherein said receptacle unit comprises a first insulator having first base with a main surface, and a first fitting portion provided on said main surface; said first fitting portion having a first stump part formed on said main surface, a fitting space formed in said first stump part and accommodating first electroconductive contact members therein, and first notches provided at opposite ends of said space and different from each other; said plug unit comprises a second insulator having a second base with a main surface, and a second fitting portion provided on said main surface; said second fitting portion having a second stump part projecting from said main surface, a plate-like part extending up from said second stump part and fitted with second electroconductive members on at least one side of said plate-like part, and second notches provided in said plate-like part at opposite ends thereof and different from each other; and said first and said second notches being asymmetrically formed so that said plate-like part can be fitted in said fitting space only when said plate-like part and said fitting space are properly oriented to each other.

* * * * *